United States Patent [19]

Clavarino

[11] Patent Number: 5,011,331

[45] Date of Patent: Apr. 30, 1991

[54] METHOD AND STRUCTURAL ELEMENTS FOR CONSTRUCTION UNDERGROUND GARAGES

[75] Inventor: Amedeo Clavarino, Viale Brianza, 12, 20127 Milano, Italy

[73] Assignees: Armedio Clavarino; Ferruccio Clavarino; Lueca Clavarino, all of Milan; Massino Medri; Umberto Capelli, both of Turin, all of Italy

[21] Appl. No.: 439,294

[22] Filed: Nov. 20, 1989

[30] Foreign Application Priority Data

Nov. 25, 1988 [IT] Italy ..... 22734 A/88

[51] Int. Cl.[5] ..... E21D 10/00

[52] U.S. Cl. ..... 405/149; 405/282; 405/303

[58] Field of Search ..... 405/132, 134, 138, 149, 405/184, 267, 282, 303; 52/742

[56] References Cited

U.S. PATENT DOCUMENTS

| | | | |
|---|---|---|---|
| 2,194,279 | 3/1940 | Goldsborough | 405/149 |
| 3,412,562 | 11/1968 | Doughty | 405/267 |
| 3,742,718 | 7/1973 | Weiss et al. | 405/138 X |
| 3,813,885 | 6/1974 | Tabor | 405/132 |
| 4,073,148 | 2/1978 | Zaretti | 405/149 X |
| 4,116,011 | 9/1978 | Girault | 405/134 |
| 4,388,021 | 6/1983 | Weiss | 405/184 |

FOREIGN PATENT DOCUMENTS 2905750 1/1981 Fed. Rep. of Germany ..... 405/149

*Primary Examiner*—David H. Corbin

*Attorney, Agent, or Firm*—Shlesinger, Fitzsimmons & Shlesinger

[57] ABSTRACT

A method for constructing underground garage parking units comprises a step of excavating two parallel trenches into which are subsequently sunk preformed reinforced concrete frames each composed of two vertical pillars with an "H"-shaped cross-section and upper and lower horizontal connecting beams disposed between them. The vertical grooves forming the "H" sections being opposed and constituting a guide for the insertion of a plurality of sheet piles so as to form continuous retaining walls in said trenches. The lower of the plurality of sheet piles being subsequently removable with a sideways movement, after excavation of a corridor by removal of the earth between said two walls, for insertion of prefabricated garages at an oblique or right angle into the vertical portions of earth thus uncovered. The upper beams of the frame constituting a support for the floors of the corridor and the pillars having their vertical grooved faces preferably at a sufficient angle, with respect to a vertical plane perpendicular to the walls, as to constitute a guide for insertion of the garages.

11 Claims, 7 Drawing Sheets

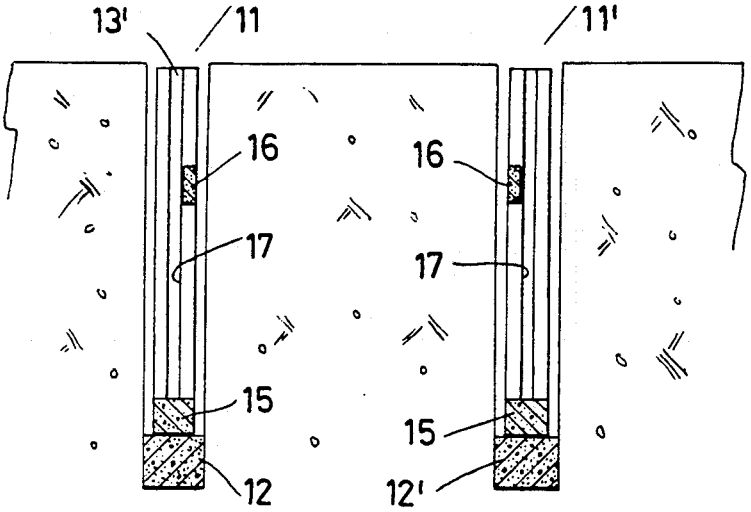
Fig.1
Fig.2
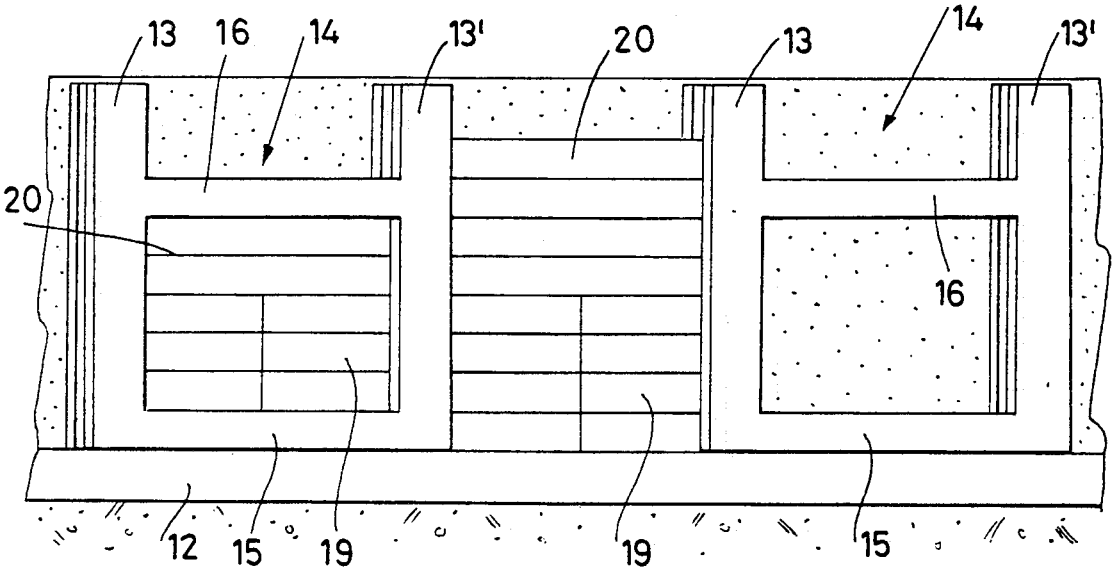
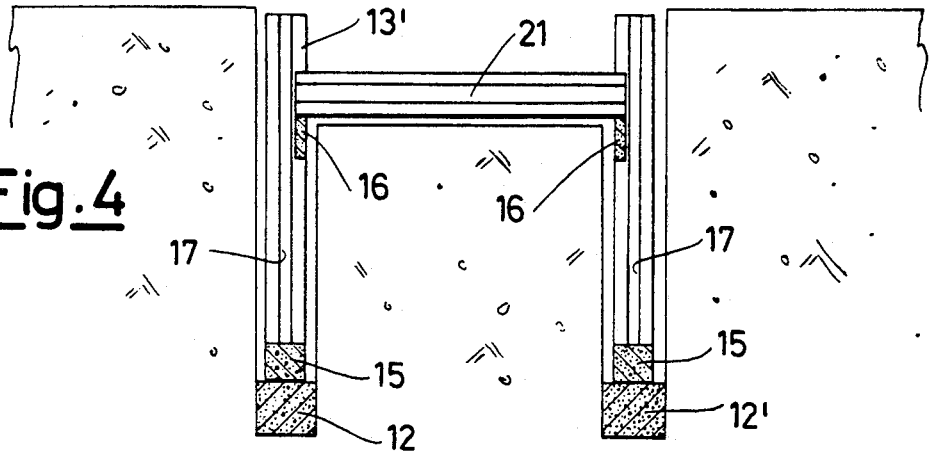
Fig.4

METHOD AND STRUCTURAL ELEMENTS FOR CONSTRUCTION UNDERGROUND GARAGES

This invention refers to a method and structural means for constructing a plurality of garages situated beneath squares, streets, tree-lined avenues, etc..

The scope of this invention is to enable the construction of said underground garages with a munimum of disturbance above ground, both in terms of the area involved and in terms of duration of the disturbance.

This scope is achieved by providing a method for constructing underground garage parking units, comprising the formation of two parallel walls by sinking pillars into the ground and inserting a plurality of sheet piles between them; the lower sheet piles of said plurality being subsequently removable, after digging a tunnel between said two walls, to enable penetration of tubular elements into the vertical portions of earth thus uncovered, the garages being installed by inserting them into the ground, in consecutive sections, and by removing the soil from inside the tubular elements.

The innovatory principles of this invention and its advantages with respect to the known technique will be more clearly evident from the following description of a possible exemplificative embodiment applying such principles with reference to the accompanying drawings, in which:

FIG. 1 shows a schematic front elevational view cut away along the line I—I of FIG. 3, of a step of the work;

FIG. 2 shows a schematic front elevational view cut away along the line II—II of FIG. 3;

FIG. 4 shows a lateral elevational view cut away along the line I—I of FIG. 3, of a possible subsequent step of the work;

Figure 3:
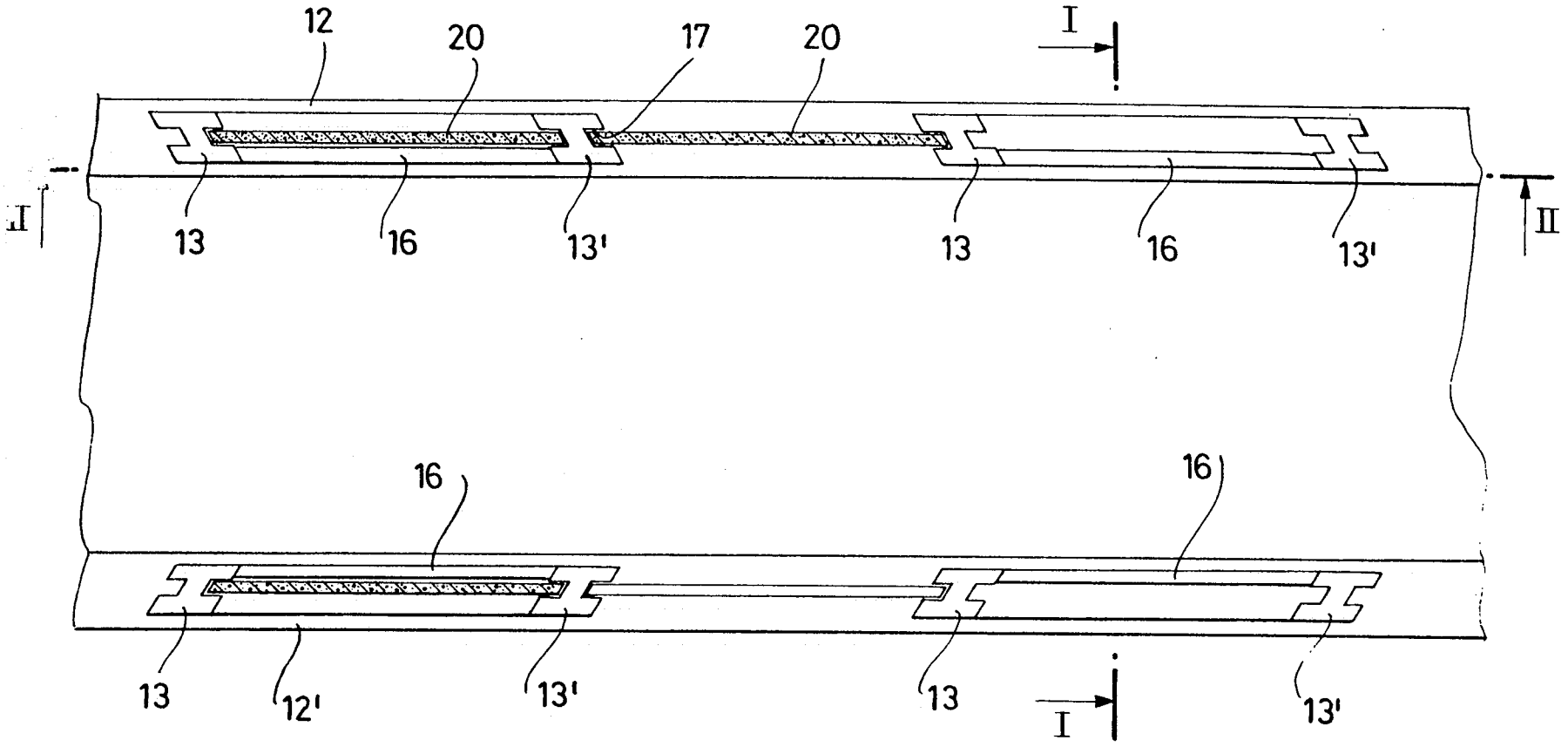
FIG. 3 shows a schematic plan view of a step of the work.

With reference to the figures, according to the invention, two parallel vertical trenches 11, 11' are dug at a suitable distance from each other, typically 4–5 mt, into which frames 14 are lowered at regular intervals (after laying, if necessary, by gravity casting of cement, two continuous bases 12, 12' on the bottom of the trenches), each of said frames being composed of two vertical pillars 13, 13' with each pillar having a skew "H"-shaped cross-section (FIG. 3) so as to form between its spaced side flanges or wings vertical grooves 17 in opposing faces thereof, a generically rectangular lower beam 15 connecting the lower ends of the pillars, and a rectangular section upper beam 16, of such thickness as to extend between the edges of only one pair of registering side flanges or wings of the "H"-shaped pillars, so as not to obstruct the entrance from above into the grooves 17.

Said pillars have their opposing vertical sides, in which are formed the grooves 17, slanted with respect to the walls of the trenches (as can be clearly seen in FIG. 3) at an angle preferably of approximately 30 degrees.

The operating procedure, described up to this point, can be replaced, wherever the nature of the soil so allows, by inserting pillars of the same type as the pillars 13, but as individual pile type elements. The insertion can be carried out by means of any of the techniques normally used for this purpose. Horizontal beams for connecting the individual pillars can be subsequently cast on site.

As can be seen in FIG. 2, using the vertical grooves of the pillars as guides, removable type sheet piles 19 are inserted between adjacent frames and between pillars of the same frame, until a certain height is reached along the pillars.

Said sheet piles 19 are designed to constitute a temporary curtain wall. Therefore, they can consists of a structure which can be demolished without any great difficulty and be consequently "disposable", or they can be made in separable parts, temporarily secured together with suitable fasteners, so as to enable them to be removed frontally (for example, by withdrawing the released piles 19 into and removing them from the tunnel or space subsequently evacuated between trenches 11, 11' as noted hereinafter) without demolishing their structure, and can therefore be reused. A simple embodiment of this type of sheet pile can also include their formation in two adjacent parts with a vertical separating line (see FIG. 2) which are connected together and kept aligned by transversal metal elements and can be removed by opening the two parts window-fashion.

Subsequently, sheet piles 20 of the type which cannot be removed frontally are inserted until the upper end of the frame is reached.

In order to prevent the soil in the two trenches from caving in, the excavation of the latter and the insertion of the frames and sheet piles can be advantageously carried out, for example, whenever the geological features of the terrain so require, using a procedure according to a known technique comprising the introduction of bentonite slurry into the excavation site.

Lastly, after having formed, by said insertion of sheet piles, two continuous parallel retainer walls, the soil between them can be removed to form a tunnel, constituting an approach path to the garages.

This path may be achieved in various per se known ways, which can be adopted selectively in accordance with parameters such as permitted costs and/or desired surface working time.

For example, an open-cast excavation technique could be used, which involves limited costs, but which occupies the entire surface above the pit (plus an obvious safety area) for the entire duration of the work.

Alternatively, to the advantage of the environment, it is possible to use underground excavation techniques, which are more costly, but which enable the surface above them to be used immediately. These well-known techniques, however, are more easily carried out due to the presence of the prefabricated walls consisting of sheet piles and frames, in this particular embodiment.

A further method, which is particularly advantageous, consists of digging a shallow pit, to a depth corresponding to the ceiling of the tunnel, making a framework from the pillars and sheet piles, covering it to restore the original configuration of the surface and then removing the soil between the walls and the ceiling of the framework, thus working in an already defined and foreset tunnel. This offers considerable economy over the closed-cast excavating method, as well as keeping the surface engaged with works for a much shorter length of time than the open-cast technique.

This latter technique can also be advantageously used, as shown in FIG. 4, by resting the ceiling, composed for example of "H" beams 21, on the upper beams 16 of the frames. The height can vary according to the thickness of the soil unaffected by the construction that one wishes to leave alone it.

For this purpose, the upper beams 16 of the frames must be made at suitable heights along the pillars 13. Once the corridor has been completed (as well, of course, as the approach ramps which may be of any shape whatsoever, helical, straight slope, etc., and made for example using the same technique but, if necessary, using pillars with a straight "H" shaped cross section), the lower sheet piles 19 are eliminated (using suitable means, of known technique, to prevent the upper sheet piles 20 from sliding downwards), by demolishing them or removing them frontally, if the configuration with a separable element to be re-utilized has been used for them.

Figure 5:
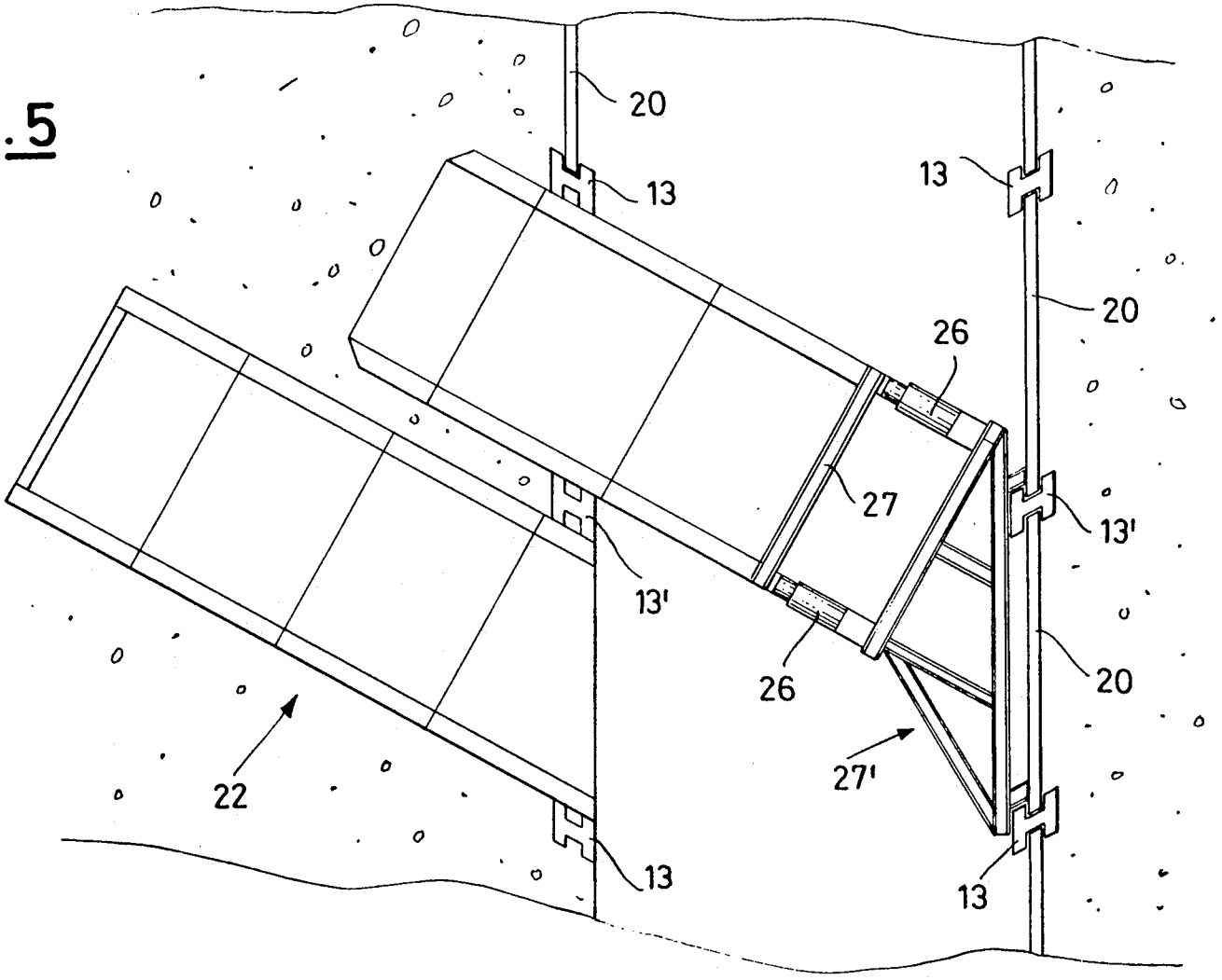
FIG. 5 shows a sectional cutaway plan view of a further step of the work.

As can be seen in FIG. 5, it is then possible to carry out the oblique insertion, into the walls of earth thus uncovered, of prefabricated sections to form garages 22 in the spaces between the pillars. The insertion is carried out with an inclination identical to the lateral faces of the frames which also act as guides.

The procedure used for penetration of the box-shaped structures of the garages into the soil is per se known and it is consequently considered unnecessary to describe it in detail since it is easily imaginable by anyone expert in the art. Indicatively, it is sufficient to point out that the insertion is carried out, in consecutive sections, by means of hydraulic jacks 26 on special thrust distributing frameworks 27, 27', as shown in FIG. 5 for an intermediate section, with subsequent removal of the soil inside the inserted and installed section of a rear wall of the garage once the insertion of all the component sections has been completed.

Figure 6:
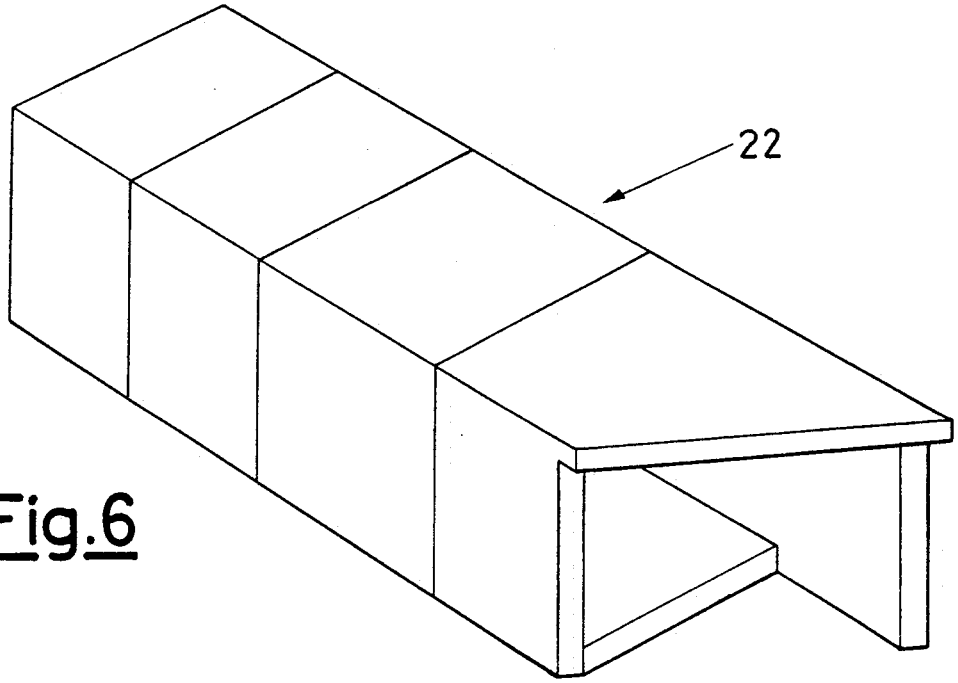
FIG. 6 shows an embodiment of a single-storey garage element.
Figure 7:
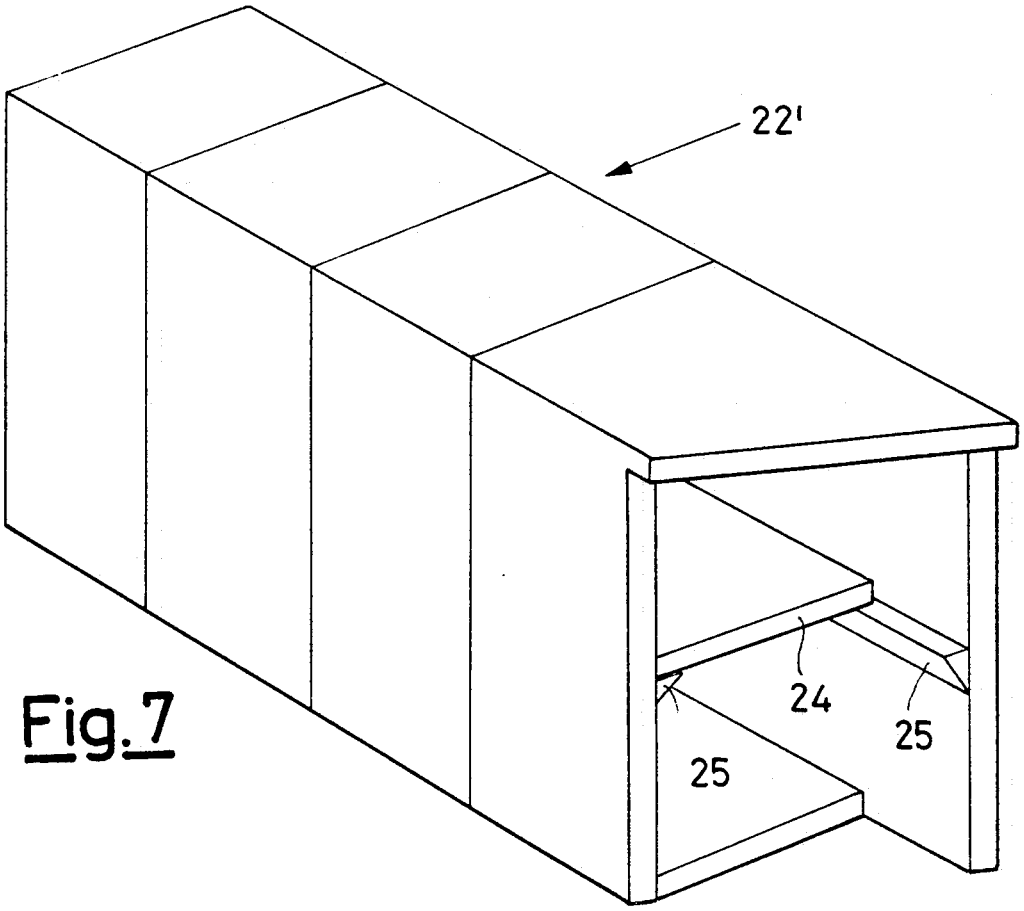
FIG. 7 shows an embodiment of a two-storey garage element.

Said box-shaped structures of the garages can be made as shown in FIG. 6, to accommodate cars on a single storey or, preferably, as shown in FIG. 7, where the garage 22' is substantially twice the height of the previous one and is provided with an intermediate slab 24 (which can also be inserted after the garage has been installed by resting it on supporting ledges 25), so as to achieve two-storey garages.

In this latter case, of course, the height of the frames and, therefore, of the tunnel will be suitably adapted and an intermediate slab will be placed in the corridor at the same height as the slab 24, thereby obtaining, for a limited extra cost, two-storey underground garage parking units.

The frames 14 and the garage sections 22 can be advantageously prefabricated in reinforced concrete in suitable moulds and the grooves 17 can be lined, if necessary, with steel guides to enable the sheet piles to slide smoothly during their insertion or removal.

The possibility of prefabricating the frames separately, away from the site, reduces the amount of space occupied during construction and substantially shortens the duration of the work.

On completion of the inserting operations the desired structure, comprising a plurality of underground garages with relative corridors and approach ramps, is thus obtained.

Figure 8:
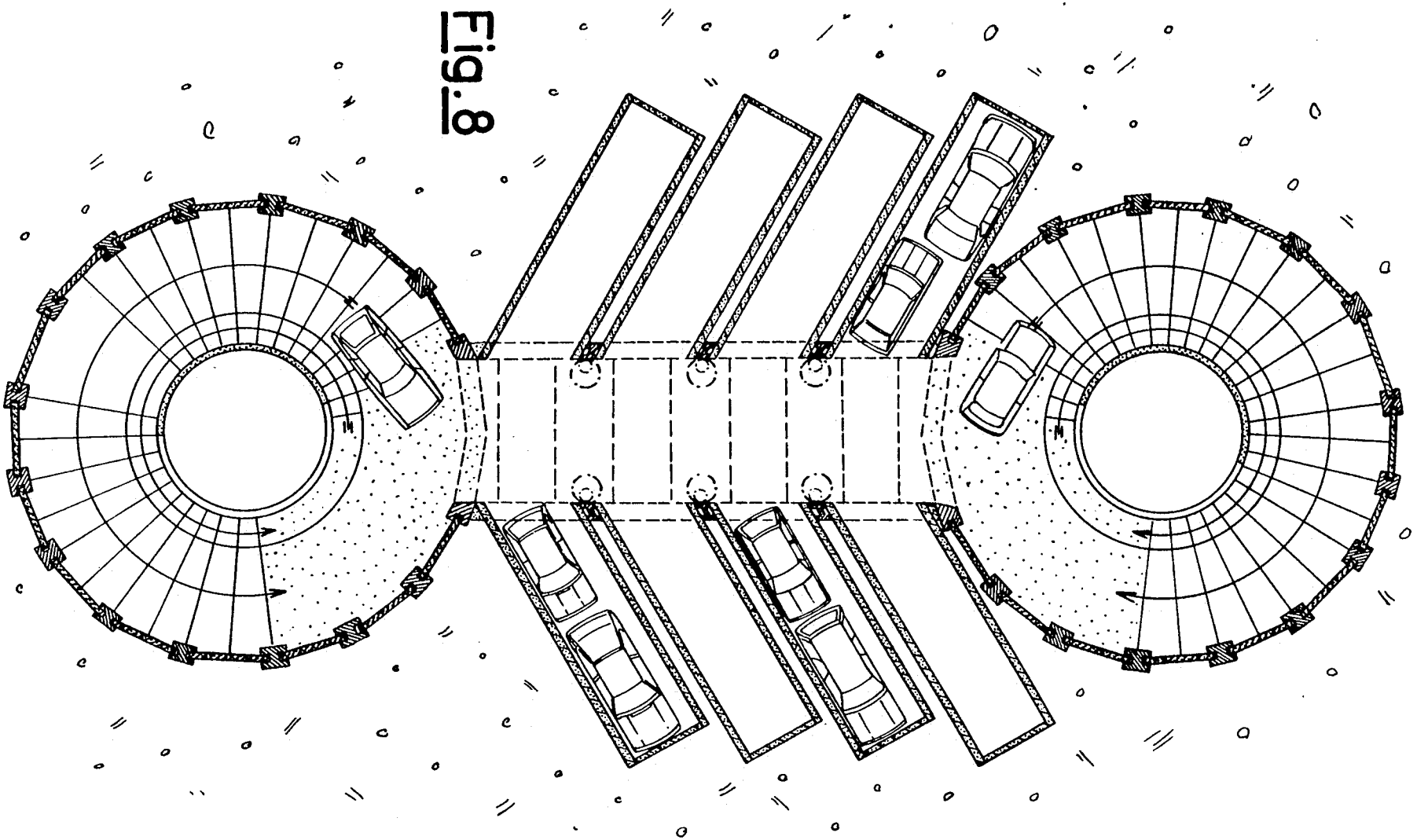
FIG. 8 shows a schematic cutaway plan view of a completed garage structure.
Figure 9:
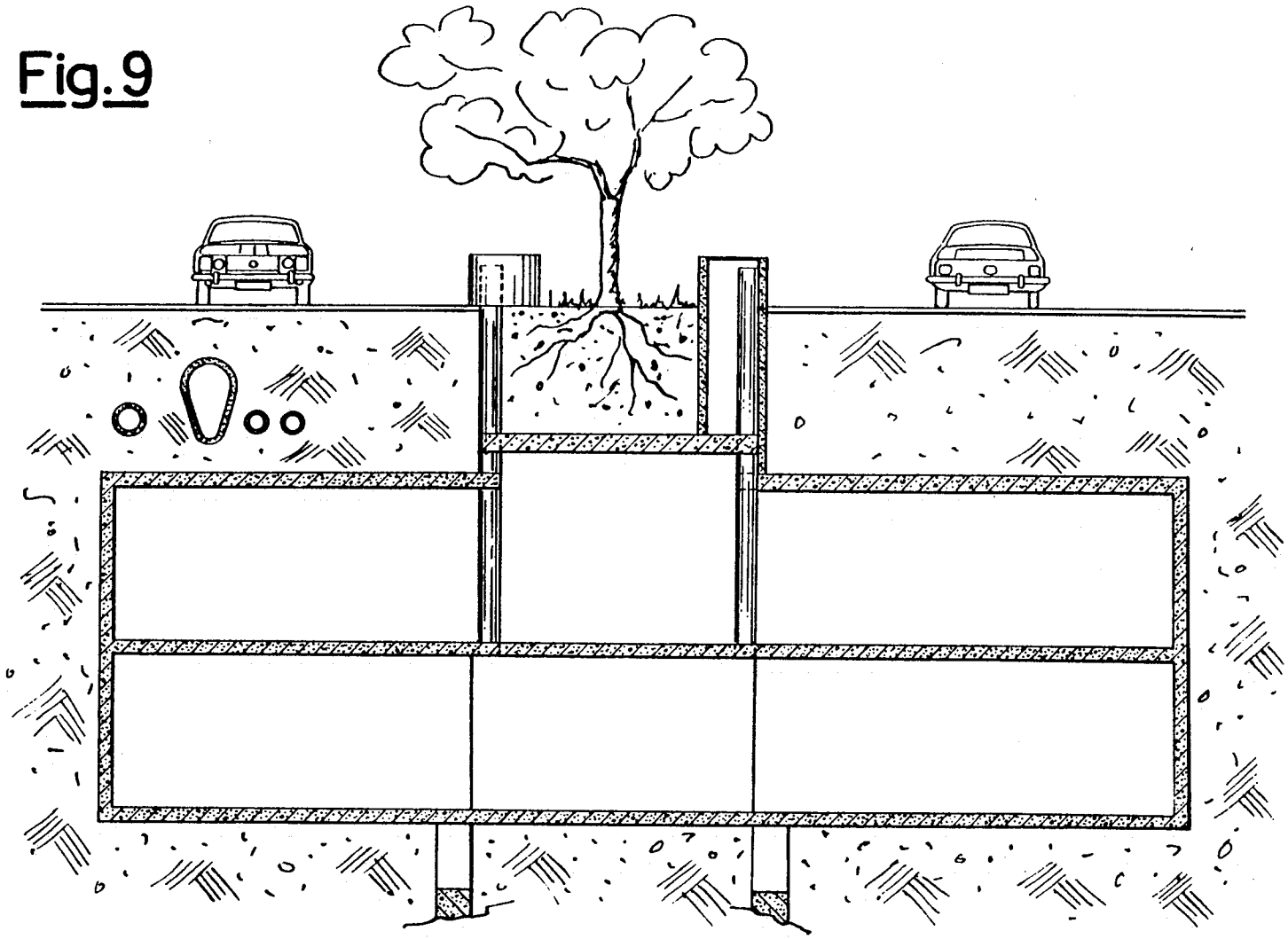
FIG. 9 shows a lateral elevation sectional cutaway view of the structure of FIG. 8.
Figure 10:
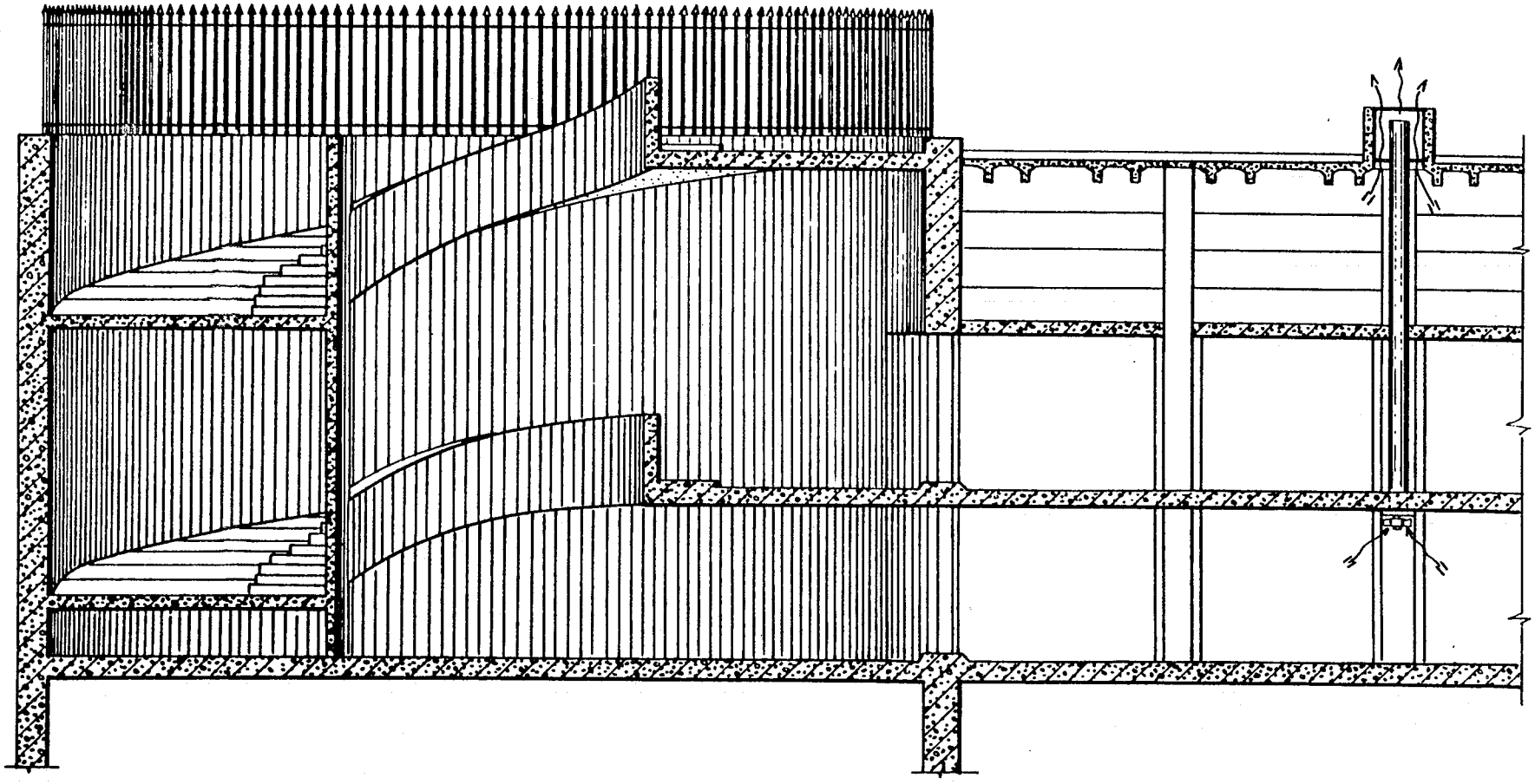
FIG. 10 shows a front elevational cutaway view of the structure of FIG. 8.

Said "rough" structure, can be finished as preferred, by laying floors, installing aeration systems and any other equipment considered necessary (as for example, shown schematically in FIGS. 8, 9 and 10 showing a possible embodiment, with spiral approach ramps at either end of the approach paths to the garages of the two-storey type) or imposed by regulations, without further work above ground.

As is easily imaginable, the shorter length of time required and the smaller area put out of action above the structure during its construction, which can be obtained with the method described above and claimed herein, makes it particularly invaluable whenever the work has to be carried out in built-up areas, for example, beneath very busy highways which, if closed to traffic for long periods of time, would cause unacceptable inconvenience.

Likewise, said method applying the innovatory advantages of this invention, makes it possible to carry out work under squares, for example, including those of particular historical interest, without causing them damage and reducing the amount of work required to put them back in order, or to carry out work under parks and gardens, etc. without causing damage to the plants above grounds or with the possibility, if necessary, of replanting them long before the end of the work (and in particular, immediately after installing the ceiling of the tunnel).

The foregoing description is obviously given here merely by way of example in order to illustrate the innovatory principles contained herein and should not therefore be understood as a limitation to the sphere of the invention claimed herein.

On the basis of these principles, the technican can easily imagine different applicational embodiments. For example, the layout of the tunnel between the garages need not necessarily be straight, but can also be winding, with suitable excavation of the trenches, so as to adapt to the layout of streets, squares, grass-covered areas, or any other sturctures present on the area above the garage parking unit.

Furthermore, whenever space permits, if required the garages can be inserted at right angles into the walls of the tunnel, in which case, the pillars can be made with right-angle corners instead of with the oblique structure described previously.

It is also possible to make the garages prefabricated with a plurality of intermediate slabs, thus creating several storeys one on top of the other.

The purely structural characteristics for the resistance of the unit to static and dynamic loads, such as the size of the pillars and beams, thickness of the slabs and the sheet piles are obviously of known technique and it is not considered necessary at this point to give further indications thereof, nor should they be deduced from the accompanying drawings, which are intentionally schematic and intended merely to illustrate the proposed embodiment.

I claim:

1. A method for constructing underground garage parking units, comprising forming two parallel walls by sinking two rows of spaced pillars into the ground, and inserting a plurality of sheet piles between adjacent pillars in each row thereof, whereby each row of pillars and the sheet piles therebetween form one of said two walls, the lower sheet piles of each said plurality thereof being subsequently removable, thereafter digging a tunnel between said two walls, removing said lower sheet piles to uncover vertical portions of the earth at opposite sides of said tunnel, inserting a plurality of tubular elements from said tunnel into the vertical portions of earth thus uncovered, and removing the earth soil from inside the tubular elements to form garage parking units therein.

2. Method as claimed in claim 1, characterized by the fact that certain of said pillars are connected together by a plurality of horizontal beams to form frames.

3. Method as claimed in claim 2, characterized by the fact that the pillars in each row thereof are arranged in spaced pairs, and the two pillars of each pair thereof are connected together by said beams to form one of said frames.

4. Method as claimed in claim 1, characterized by the fact that said pillars have vertical grooves to enable the insertion from above of the lateral edges of the sheet piles.

5. Method as claimed in claim 3, characterized by the fact that said two pillars of each pair are connected by an upper beam and a lower beam, and the upper beams of said pairs constitute a bearing for the ceiling of the tunnel.

6. Method as claimed in claim 1, including inserting said tubular elements into the ground at an angle inclined in a horizontal plane, with respect to a plane parallel to said walls.

7. Method as claimed in claim 6, characterized by the fact that the pillars have vertical faces, extending in the direction of insertion of the tubular elements, sloping with the same degree of inclination as the tubular elements, so as to constitute a guide for the insertion of the latter.

8. Method as claimed in claim 1, including forming said garage units with at least one intermediate horizontal slab, so as to form multiple garage units.

9. Method as claimed in claim 1, including sinking the pillars into the ground by digging a trench for each wall and simultaneously pouring in fluid thrust compensation material, in particular bentonite slurry.

10. Methods as claimed in claim 9, including casting a cement base on the bottom of the trench to support the pillars.

11. Methods as claimed in claim 1, characterized by the fact that, said lower sheet piles are composed of openable and separable parts, which can be removed for re-utilization.

* * * * *

UNITED STATES PATENT OFFICE

CERTIFICATE OF CORRECTION

Patent No. 5,011,331 Dated April 30, 1991

Inventor(s) Amedeo Clavarino

It is certified that error appears in the above-identified patent and that said Letters Patent is hereby corrected as shown below:

On the title page of the patent, in paragraph (73):

"Armedeo" should be --Amedeo--; and "Lueca" should be --Luca--.

Signed and Sealed this

Fifth Day of January, 1993

*Attest:*

DOUGLAS B. COMER

*Attesting Officer*

*Acting Commissioner of Patents and Trademarks*